United States Patent [19]

Hoffmann

[11] Patent Number: 4,758,505

[45] Date of Patent: Jul. 19, 1988

[54] PROCESS AND AN APPARATUS FOR THE PRODUCTION OF PHOTOGRAPHIC SILVER HALIDE EMULSIONS

[75] Inventor: Klaus Hoffmann, Leverkusen, Fed. Rep. of Germany

[73] Assignee: Agfa Gevaert Aktiengesellschaft, Leverkusen, Fed. Rep. of Germany

[21] Appl. No.: 923,967

[22] Filed: Oct. 28, 1986

[30] Foreign Application Priority Data

Nov. 9, 1985 [DE] Fed. Rep. of Germany ..... 3539845

[51] Int. Cl.[4] ..... G03C 1/02

[52] U.S. Cl. ..... 430/569; 430/567; 430/642

[58] Field of Search ..... 430/569, 642, 567

[56] References Cited

U.S. PATENT DOCUMENTS

| | | | |
|---|---|---|---|
| 2,146,938 | 2/1939 | Claus | 430/642 |
| 3,206,313 | 9/1965 | Porter et al. | 430/569 |
| 3,790,386 | 2/1974 | Posse et al. | 430/642 |
| 3,801,326 | 4/1974 | Claes | 430/642 |
| 4,147,551 | 4/1979 | Finnicum et al. | 430/569 |
| 4,171,224 | 10/1979 | Vermille et al. | 430/569 |
| 4,334,012 | 6/1982 | Mignot | 430/567 |
| 4,336,328 | 1/1982 | Brown et al. | 430/569 |
| 4,539,290 | 9/1985 | Mumaw | 430/569 |
| 4,610,958 | 9/1986 | Matsuzaka et al. | 430/569 X |
| 4,665,017 | 5/1987 | Mifune et al. | 430/569 |

FOREIGN PATENT DOCUMENTS 1207791 12/1965 Fed. Rep. of Germany .

OTHER PUBLICATIONS

Research Disclosure, #13122, "Photographic Gelatin or Emulsion Purification", Mar. 1975.

*Primary Examiner*—Mukund J. Shah

*Attorney, Agent, or Firm*—Connolly and Hutz

[57] ABSTRACT

Silver halide emulsions are prepared by precipitation, transfer of the silver halide emulsion from the precipitation chamber into a separate circuit comprising a cleaning stage for the removal of dispersion medium and compounds soluble therein and exit into a collecting vessel.

8 Claims, 1 Drawing Sheet

Figure 1:
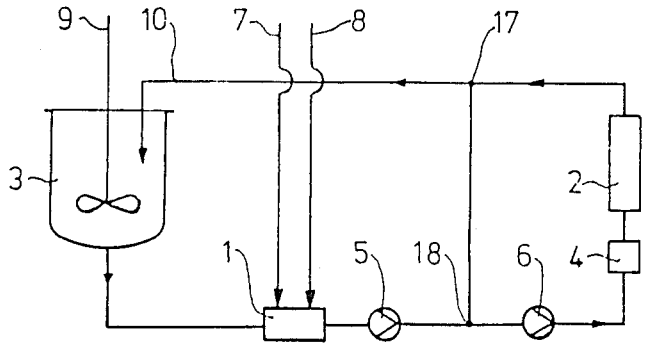

PROCESS AND AN APPARATUS FOR THE PRODUCTION OF PHOTOGRAPHIC SILVER HALIDE EMULSIONS

This invention relates to a process and to an apparatus for the production of photographic silver halide emulsions.

It is already known that photosensitive silver halide emulsions can be formed by precipitating corresponding silver salts in a binder. In particular, it is known that silver halide emulsions can be prepared by precipitation of silver halide in a binder, gelatin preferably being used as the binder. The silver halide may be precipitated by addition of an aqueous solution of a silver salt to a halide solution in gelatin. The size of the silver halide grains obtained is controlled inter alia by the temperature of the solution, the addition time and the silver halide excess. Conversely, it is also known that an aqueous solution of a halide may be added to an aqueous solution of a silver salt.

In addition, it is known that aqueous solutions of a silver salt and a halide may be run simultaneously into a receiving solution by the so-called double jet process. Suitable processes of this type are described, for example, in British Pat. No. 1 027 146 and in the Article by E. MOISER and S. WAGNER in "Berichte der Bunsengesellschaft fur physikalische Chemie", 67 (1963), pages 356 to 359. Double jet processes are also known from British Pat. No. 1 302 405 and from U.S. Pat. Nos. 3,801,326, 4,046,376, 3,790,386, 3,897,935, 4,147,551 and 4,171,224.

It is also known that silver halide emulsions can be prepared by mixing emulsions of different solubility, followed by dissolution and crystallization, for example in the presence of silver halide solvents. A precondition for processes such as these is that the silver halide crystals used for the dissolution and crystallization should show different solubility. Processes of this type are known, for example, from U.S. Pat. Nos. 2,146,938, 3,206,313, 3,317,322 and from DE-AS No. 1 207 791.

In order to prevent salts in the emulsion layers of a recording material from crystallizing out after casting and other photographic or mechanical disadvantages, the soluble salts and other soluble compounds formed during preparation of the emulsions have to be removed. The so-called flocculation process is generally used for this purpose. In this process, the silver halide emulsion is flocculated and then washed and optionally concentrated. Reference is made in this connection to Ullmanns Enzyklopadie der Technischen Chemie, 4th Edition, Vol. XVIII, 1979, pages 423 et seq. DE-OS No. 2 436 461 already describes a process for removing salts from and optionally concentrating silver halide emulsions, in which the photogaphic emulsion is filtered through capillary membranes using a pressure difference. The use of ultrafiltration in the preparation of photographic silver halide emulsions is also known from Research Disclosure No. 10 208 (1972), Research Disclosure Nos. 13 122 (1975) and 16 351 (1977).

It is already known from U.S. Pat. No. 4,334,012 and from U.S. Pat. No. 4,336,328 that ultrafiltration can be used during the grain growth of a silver halide emulsion.

However, the last-mentioned processes are attended by the disadvantage that, when the ultrafiltration apparatus is switched on, deposits of temporarily existing, large particles can actually occur before the end of the precipitation crystallization, particularly where high concentrations of peptizing agent are used. Particles such as these can cause fouling of protective filters preceding the ultrafiltration module or of flow passages in the ultrafiltration module.

For this reason, it is of advantage not to switch on the ultrafiltration module until after the precipitation crystallization is over or at least until after the deposit-producing phase of the precipitation is over.

On the other hand, the advantages of ultrafiltration can only be fully utilized if the ultrafiltration module can be used in flow communication with the precipitation chamber and the collecting vessel. Thus, on completion of the precipitation phase, the emulsion may be economically purified and concentrated before further processing (such as ripening, hardening or introduction as a seed crystal or as a component for dissolution and crystallization) without uneconomical stops for transport and/or intermediate storage of the emulsion.

However, another difficulty arises here, namely: the volume (or mass) flow required for optimal flow across the membranes of the ultrafiltration module is generally greater than the upper limits to this flow imposed by other factors concerned with process technology. Thus, the volume of emulsion flowing through the precipitation chamber is limited by the residence times in that chamber which have to be observed to obtain a uniform grain size. The cross-sections of the tubes and valves dimensioned for this flow through the precipitation chamber are often too small for the flow required by the ultrafiltration module. In this context, volume flow is understood to be the volume of liquid flowing through each cross-section of a pipe per unit of time, as measured for example in 1/minute. Accordingly, mass flow is the mass per unit of time, as measured for example in kg/minute. The residence time is understood to be the volume of the precipitation chamber divided by the volume flow through that chamber.

However, excessively low volume flows in the circuit containing the ultrafiltration module lead to difficulties because (a) permeate production becomes too small so that the amount of dispersion medium removed per unit of time is not sufficient for cleaning and/or concentrating in reasonable times; (b) the flow passages can become completely or partly blocked by deposits. Permeate production is understood to be the volume flow of permeate based on the unit of filter area, as measured for example in $1/(m^2\ min.)$.

On the other hand, it may be necessary in a certain phase of a precipitation, the so-called seed-forming phase, to return the precipitate formed to the precipitation chamber by a short route to enable it to grow to a stable grain size before mixing with the total quantity of peptizer solution or emulsion in the collecting vessel.

These problems are known from DE-OS No. 25 55 364 which describes a solution for the case where the precipitation chamber ("mixing chamber") is vertically arranged in a collecting vessel ("reaction vessel") and provided with two independent stirrers. However, this solution is attended by the disadvantage that the recycling of the precipitate through the aqueous peptizer solution of the collecting vessel is incomplete and difficult to control.

The present invention relates to a process for the preparation of photosensitive silver halide emulsions by (a) reaction of at least one soluble silver salt with at least one soluble halide in a dispersion medium which dissolves the halide and/or (b) combination of silver halide emulsions of different solubility in a dispersion medium under at least partly dissolving conditions in a reaction chamber 1 and at least partial removal of dispersion medium and any compounds dissolved therein, characterized in that (1) before termination of the reaction (a) and/or the combination (b), the silver halide emulsion leaving the reaction chamber (1) is continuously delivered into a separate circuit KS-1 comprising a cleaning stage for the removal of dispersion medium and compounds soluble therein and (2) after at least one passage through the cleaning stage 2, the silver halide emulsion leaves the circuit KS-1 and enters (3) a collecting vessel 3.

The "separate circuit" is understood to be a circuit of pipes, shut-off valves, pumps etc. in flow communication with the reaction chamber for partial recycling of the emulsion from the exit of the cleaning stage to the entrance thereof, by-passing the reaction chamber or by-passing the collecting vessel.

The usual dispersion media may be used. One particularly preferred dispersion medium is water or a solution consisting essentially of water.

In one preferred embodiment, the photosensitive silver halide emulsion is prepared by reaction of a soluble silver salt, particularly silver nitrate, with at least one soluble halide, particularly a water-soluble halide in aqueous solution.

The mass or volume flow of the silver halide emulsion circulating in the circuit KS-1 is preferably greater, at least by a factor of 1.2, than on entry into the collecting vessel 3.

In one preferred embodiment, the reaction between the silver salts and halides is carried out in a precipitation chamber separate from the collecting vessel.

In another preferred embodiment, the silver halide emulsion is at least partly recycled from the collecting vessel 3 to the circuit KS-1.

In another preferred embodiment, the emulsion precipitated in the precipitation chamber 1 is periodically conducted into the collecting vessel 3 by-passing the circuit KS-1. In this case, the cleaning stage can be periodically emptied and flushed out.

In another preferred embodiment, the silver halide emulsion, after passing through the cleaning stage 2, is recycled partly in front of and partly behind the precipitation chamber 1. In this case, the flow into the collecting vessel 3 can be at least periodically interrupted.

Suitable cleaning arrangements are those by which dispersion media and molecules dissolved therein can be removed from the emulsion on a continuous basis.

This may be done, for example, by a combination of dialysis or electrodialysis for the removal of salts or a combination of osmosis or reverse osmosis for the removal of water. Membrane permeation processes such as these using differences in concentration or pressure through the membrane are described, for example, in the book by R. Rautenbach and R. Albrecht entitled "Membrantrennverfahren (Membrane Separation Processes)", Otto Salle Verlag Frankfurt und Verlag Sauerlander Aarau 1981. Since silver halide particles and gelatin molecules which have to be retained are large by comparison with water or salt molecules or ions which are to be removed, it is also possible to use microfiltration processes using micropore filters.

In a particularly preferred embodiment, an ultrafiltration module is used for cleaning. The ultrafiltration module preferably contains membranes of inert, nonionic polymers which are suitable for removing soluble salts from photographic emulsions and, optionally, also for concentrating these emulsions by reducing their volume by the removal of dispersion medium.

The action mechanism of preferred membranes is described in British Pat. No. 1 307 331. The membranes in question consist of substituted olefins or aromatic polymers which represent anisotropic, semipermeable membranes, show considerable mechanical, thermal and chemical stability and are photographically inactive. Suitable membranes may be made for example from polyvinylacetate, polyvinylalcohol, polyvinylformate or polyvinylethers, such as for example polyvinylmethyl or ethylethers, and also of polyamides, polyimides, polyvinyl and polyvinylidene chloride, aromatic polymers, such as aromatic polyesters, or polytetrafluoroethylene.

Preferred membranes are, for example, membranes of polyamides, polyvinylchloride and polytetrafluoroethylene.

Membranes of regenerated cellulose or cellulose esters, such as cellulose acetate, or mixed cellulose esters may also be used with advantage for the process according to the invention.

The membranes are preferably permeable to molecules having relative molecular weights of up to about 300,000 and, more especially, of up to about 50,000. The gelatinsilver halide emulsions to be cleaned by the process according to the invention may vary considerably in their concentration of silver halide, their gelatin content, their salt content and their pH-value. In general, the soluble salt content is from 0.1 to 3 moles per liter emulsion, depending on the production conditions. The silver halide content may be from 0.1 to 3 moles and preferably from 0.1 to 1 mole per liter emulsion. The gelatin concentration may be increased from 0.01% to 12% and preferably to 8%, temperatures of from 20° C. to 75° C. and preferably of from 30° to 50° C. being maintained.

The pressure difference across the membrane is preferably from 0.3 to 4 bar.

The present invention also relates to a suitable apparatus for the preparation of photographic silver halide emulsions comprising (1) a reaction chamber 1, (2) a collecting vessel 3 for collecting the silver halide emulsion and (3) a cleaning stage 2 for the removal of soluble compounds and dispersion media.

The apparatus according to the invention is characterized in that (a) the cleaning stage 2 is present in a separate circuit KS-1, (b) the reaction chamber 1 and the collecting vessel 3 are not part of the circuit KS-1 but (c) are connected by feed pipes to the circuit KS-1.

In one particularly preferred embodiment, the cleaning stage 2 is in the form of an ultrafiltration module.

The apparatus according to the invention is described in more detail in the following with reference to the accompanying drawings, wherein:

FIG. 1 diagrammatically illustrates an apparatus according to the invention comprising a reaction chamber 1, a cleaning stage 2 and a collecting vessel 3, the cleaning stage 2 being present in a circuit KS-1 which, in addition to the cleaning stage, comprises the three-way cocks 17 and 18, a pump 6 and a preliminary filter 4.

Figure 2:
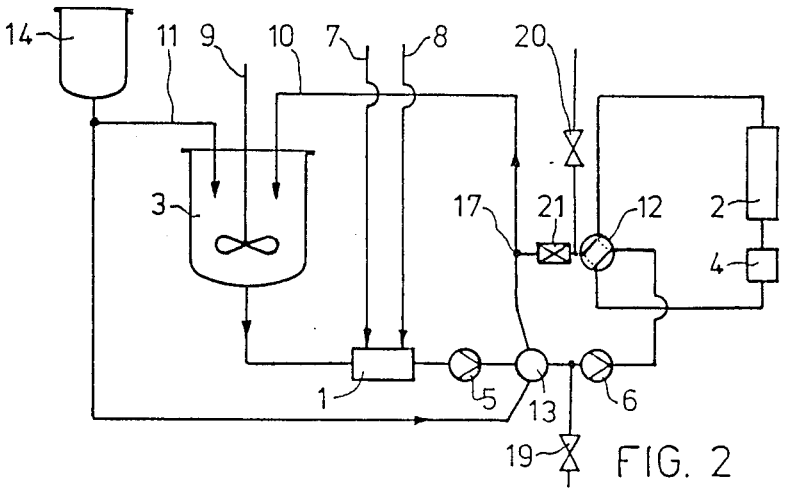

FIG. 2 shows another apparatus according to the invention which, compared with the apparatus shown in FIG. 1, additionally comprises a storage vessel 14 which may be filled, for example, with an aqueous gelatin solution and in which the cleaning stage 2 may be traversed in one direction or the other by means of the multiway cock 12. In addition, the apparatus shown in FIG. 2 comprises separate outlet and inlet valves 19 and 20 and the shutoff valve 21 by means of which the cleaning stage 2 can be flushed out with other media for cleaning and aired.

Figure 3:
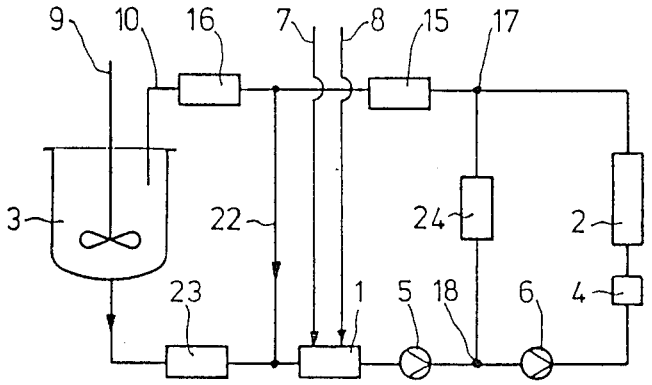

FIG. 3 shows an apparatus according to the invention in which part of the silver halide emulsion, after leaving the circuit KS-1 is recycled behind and another part ahead of the reaction chamber 1.

FIG. 1 is described in detail in the following. The apparatus comprises an inlet 7 for the introduction of water-soluble silver salts and an inlet 8 for the introduction of water-soluble halides into the reaction chamber 1. From the reaction chamber 1, the emulsion containing the pecipitated silver halide, after passing through the cock 18, is pumped by the pump 5 into the circuit KS-1 which comprises an additional pump 6 for increasing the throughflow rate. After passing through the preliminary filter 4, the silver halide emulsion enters the cleaning stage 2 (preferably an ultrafiltration module) and, at the cock 17, is partly conducted through the inlet 10 into the collecting vessel and partly recycled into the circuit KS-1. The circuit KS-1 comprises the three-way cocks 17 and 18, the pump 6, the preliminary filter 4 and the cleaning stage 2. A stirrer 9 is provided in the collecting vessel 3. From the collecting vessel, the emulsion can be returned to the reaction zone 1.

However, the apparatus shown in FIG. 1 may also be used for the preparation of silver halide emulsions by combination of silver halide emulsions of different solubility. To this end, the silver halide emulsions of different solubility may be introduced into the reaction zone through the inlets 7 and 8. It is also possible to introduce at least one of these silver halide emulsions beforehand into the reaction zone 1.

Compared with the apparatus shown in FIG. 1, the apparatus shown in FIG. 2 additionally comprises the following features:

From a storage vessel 14, a reactant or the dispersion medium may be additionally introduced into the collecting vessel 3 through the inlet 11. In addition, the contents of the storage vessel 14 may be introduced into the apparatus through the multiway cock 13. In this case, the cleaning stage 2 is situated in a separate circuit KS-1 comprising the multiway cock 13, the pump 6 the multiway cock 12, the preliminary filter 4, the cleaning stage 2 and the cock 17. The multiway cock 12 may be set up in such a way that the emulsion flows first through the preliminary filter 4 and then through the cleaning stage 2 or first through the cleaning stage 2 and then through the preliminary filter 4. By means of the multiway cock 13, the silver halide precipitated in the precipitation chamber 1 may be conducted into the circuit KS-1, although it is also possible for the precipitated silver halide to be delivered directly, i.e. by-passing the circuit KS-1, through the inlet 10 into the collecting vessel 3, in which case the shut-off valve 21 is closed. With an arrangement such as this, the cleaning stage 2 may be cleaned through the valves 19 and 20 without interrupting precipitation.

Compared with the apparatus shown in FIG. 1, the apparatus shown in FIG. 3 additionally comprises the throttle valves 15, 16, 23 and 24 and, by means of the connecting element 22, enables a circuit incorporating the precipitation chamber 1 to be created with exclusion of the collecting vessel 3.

By using a cleaning stage, more especially in the form of an ultrafiltration module, in a separate circuit KS-1 in accordance with the invention, it is possible to remove water-soluble compounds, particularly watersoluble salts, during the precipitation, in precipitation intervals and after the precipitation and to concentrate to silver halide emulsion by removal of water.

In one preferred embodiment, the precipitation is carried out in the presence of a protective colloid or binder. Suitable protective colloids and binders are the usual types, for example proteins, particularly gelatin, alginic acid or derivatives thereof, such as esters, amides or salts, cellulose derivatives, such as carboxymethyl cellulose and cellulose sulfates, starch or derivatives thereof or hydrophilic synthetic binders, such as polyvinylalcohol, partially hydrolyzed polyvinylacetate and polyvinylpyrrolidone. The binders may contain in admixture with the hydrophilic binders other synthetic binders in dissolved or dispersed form, such as homopolymers or copolymers of acrylic or methacrylic acid or derivatives thereof, such as esters, amides or nitriles, also vinyl polymers, such as vinylesters or vinylethers. In this connection, reference is made for example to Research Disclosure No. 22 534, 1983, page 23. However, the silver halide emulsions may also be precipitated in the absence of peptizing agents. Where precipitation is carried out in the presence of gelatin, a gelatin-to-silver ratio of from 0.01 to 1 is preferably maintained at the end of precipitation.

Chloride, bromide and iodide or mixtures thereof may be used as halide in the photosensitive silver halide emulsions.

In one preferred embodiment, the silver halide crystals are predominantly compact crystals, for example cubic or octahedral crystals or transitional forms. They may be characterized in that they essentially have a thickness of greater than 0.2 μm on completion of precipitation. The average diameter-to-thickness ratio is preferably less than 8:1, the diameter of a grain being defined as the diameter of a circle with an area corresponding to the projected area of the grain. In another preferred embodiment, however, all the emulsions or individual emulsions may even contain essentially tablet-form silver halide crystals in which the diameter-to-thickness ratio is greater than 8:1.

The emulsions may be chemically sensitized. The usual sensitizing agents are suitable for chemically sensitizing the silver halide grains. Sulfur-containing compounds, for example allylisothiocyanate, allylthiourea and thiosulfates are particularly suitable. Other suitable chemical sensitizers are noble metals and noble metal compounds, such as gold, platinum, palladium, iridium, ruthenium or rhodium. This method of chemical sensitization is described in the article by R. Koslowsky, in Z.Wiss.Phot. 46, 65–72 (1951). The emulsions may also be sensitized with polyalkylene oxide derivatives. In this connection, reference is made to Research Disclosure No. 17 643, Section III.

The emulsions may be optically sensitized in known manner, for example with the usual polymethine dyes, such as neutrocyanines, basic or acidic carbocyanines, rhodacyanines, hemicyanines, styryl dyes, oxanols and the like. Sensitizers such as these are described by F. M. Hamer in "The Cyanine Dyes and Related Compounds", (1964). In this connection, reference is made in particular to Ullmanns Enzyklopadie der technischen Chemie, 4th Edition, Vol. 18, pages 431 et seq. and to Research Disclosure No. 17 643, Section IV.

The usual antifogging agents and stabilizers may be used. Particularly suitable stabilizers are azaindenes, preferably tetra- or penta-azaindenes, particularly those substituted by hydroxyl or amino groups. Compounds such as these are described, for example, in the Article by Birr in Z.Wiss.Phot. 47, 1952, pages 2 to 58. Other suitable stabilizers and antifogging agents are described in Research Disclosure No. 17 643, Section IV.

The emulsions may be hardened in the usual way, for example with hardeners of the epoxy type, the heterocyclic ethylene imine type and the acryloyl type. The emulsions may also be hardened by the method according to German Offenlegungsschrift No. 2 218 009 in order to obtain color photographic materials which are suitable for hightemperature processing. The emulsions may also be hardened with hardeners of the diazine, triazine or 1,2-dihydroquinoline type or with hardeners of the vinylsulfone type. Other suitable hardeners are known from German Offenlegungsschrifts Nos. 2 439 551, 2 225 230, 2 317 672 and from Research Disclosure No. 17 643, Section XI.

Other suitable additives are described in Research Disclosure No. 17 643 and in Product Licensing Index, December 1971, pages 107–110.

Solvents, chemical sensitizers and spectral sensitizers may actually be added for precipitation.

Basically, silver halide emulsions of virtually any type may be precipitated in accordance with the invention. In particular, both homodisperse and also heterodisperse silver halide emulsions may be prepared by the process according to the invention.

Homodisperse emulsions are understood to be emulsions having a narrow particle size distribution, i.e. emulsions in which at least 95% of the silver halide grains have a diameter differing by no more than 40% and preferably by no more than 30% from the average grain diameter. The silver halide grains may have any of the known forms, for example cubic, octahedral or even a mixed tetra-decahedral form.

Heterodisperse emulsions are particularly understood to be emulsions in which at least 10% and preferably at least 20% of the silver halide grains have a diameter differing by at least 40% from the mean grain diameter.

The absolute value of the mean grain size of the metal salts produced in accordance with the invention, particularly the silver halide emulsions prepared in accordance with the invention, may vary within wide limits. For example, it is possible in accordance with the invention to prepare both fine-grained silver halide emulsions having a mean diameter of less than 0.5 μm and preferably less than 0.3 μm and also coarse-grained silver halide emulsions having a mean grain diameter of from 0.5 to 4 μm.

According to the invention, it is possible in principle to prepare emulsions for various photographic materials such as, for example, negative emulsions of high surface sensitivity, negative emulsions of high internal sensitivity, direct-positive emulsions which may be surface-fogged or -unfogged, print-out emulsions, reversal emulsions, emulsions for black-and-white materials and for color materials, emulsions having a defined grain distribution and halide topography, more especially having a defined halide and particularly iodide gradient.

EXAMPLE 1

A monodisperse AgBr-emulsion of predominantly cubic crystal habit is prepared in two steps (seed crystal precipitation and coating precipitation) as follows using the apparatus shown in FIG. 1:

The cleaning stage 2 is an ultrafiltration module comprising polysulfone membranes having a separation limit of 50,000 and a filter area of 1.4 $m^2$. The prefilter 4 is a stainless steel sieve. 5 and 6 are centrifugal pumps. The pump 5 has an output of 40 1/min. and the pump 6 an output of 100 1/min.

1.1: Seed crystal precipitation:

A solution (1) consisting of 9 1 water and 260 g of an inert bone gelatin is initially introduced into the collecting vessel. The components used for the precipitation crystallization are a solution (2) of 3670 g silver nitrate and 6 1 water and a solution (3) of 2570 g potassium bromide and 6.1 1 water. Solutions (2) and (3) are introduced into the reaction chamber 1 through pipes 7 and 8, initially with a volume flow of 120 ml/min. After 5 minutes, the volume flow into the reaction chamber 1 is reduced to around 60 ml/min. A volume flow of approximately 40 1/min is maintained through the circuit 3/1/5/18/17/10 by means of a pump 5 while the inlets 7 and 8 are open. In the meantime, the unused parts of the separate circuit are filled with water.

During the precipitation, the pAg-value in the collecting vessel is kept at 6.9 by precision regulation of the inlet 8. The temperature in the collecting vessel is kept at 50° C.

After solution (2) has been completely run in, the inlets 7 and 8 are closed and the separate circuit is brought into operation by switching on the pump 6 and reversing the shut-off valves 17 and 18 in such a way that the emulsion flows through the cleaning stage 2 with the optimal volume flow of 90 1/min. for ultrafiltration, the flow through the collecting vessel 3 remaining at the same low level (40 1/min.). A permeate flux of initially 1 1/min. is thus obtained. By running off 15 1 permeate, the emulsion is concentrated and then diafiltered at constant volume by replacing the permeate flowing off with fully deionized water. 20 l of this water are required for salt removal. During this cleaning phase, there are only about 3 l in the collecting vessel. Nevertheless, no foam is formed in the open vessel. On completion of the washing process, the circuits are emptied and the emulsion combined in the collecting vessel.

The emulsion obtained has an average grain size of 0.17 μm; a silver bromide concentration of 406 g AgBr Per kg emulsion and a gelatin-to-silver bromide mass ratio of 0.06.

1.2: Further growth:

90% of the salt-free emulsion prepared as described in 1.1 are removed from the system. The 10% remaining in the collecting vessel are mixed with a solution of 6 l water and 210 g inert gelatin. The precipitation components are now a solution (4) of 4900 g silver nitrate in 8.0 l water and a solution (5) of 3500 g potassium bromide in 8.1 l water.

These solutions are introduced into the reaction chamber 1 through pipes 7 and 8 at a constant volume flow of 100 ml/min., the emulsion being pump-recirculated as in 1.1.

The temperature in the collecting vessel is kept at 60° C. and the pAg-value at 6.7. The subsequent cleaning and concentration is carried out in the same way as in seed crystal precipitation.

The emulsion obtained has an average particle size of 0.48 μm, an AgBr-concentration of 393 g/kg and a gelatin-to -AgBr mass ratio of 0.04.

EXAMPLE 2

In this Example, a mixture (6) of 4 l water, 218 g of an inert gelatin and 1.88 kg of the emulsion according to Example 1.2 are initially introduced into the collecting vessel 3 as seed crystals.

The precipitation partners used are a solution (7) of 5000 g silver nitrate and 8.1 l water and a solution (8) of 3500 g potassium bromide and 8.2 l water. The flow volume into the reaction chamber is now 50 ml/min. and the flow of emulsion through the reaction chamber the same as in Example 1. The temperature in the collecting vessel is kept at 70° C. and the pAg-value at 6.5.

After a flow-in time of 70 minutes, the separate circuit KS-1 which, hitherto, has been filled with water is brought into operation. Whereas a volume flow of 100 L/min. is produced in this cleaning circuit, the volume through the collecting vessel 3 is kept constant at 40 L/min. until the inlets 7 and 8 are closed after a total inflow time of 160 minutes. The transport of the emulsion through the reaction chamber 1 leads simultaneously to its introduction into the cleaning stage 2.

By switching the ultrafiltration module, 100 ml permeate per minute are removed from the emulsion, i.e. the volume flow or permeate is limited to this value by a throttle valve (not shown).

On closure of the inlets, the emulsion is cleaned
at a permeate flux of 600 ml/min.
with simultaneous addition of fully deionized water
at constant volume
at a throughput of 25 l.

The emulsion obtained has an average grain size of 1 μm, a silver bromide concentration of 346 g per kg emulsion and a gelatin-to-silver bromide mass ratio of 0.04.

The emulsion thus prepared in a single operation does not require any further salt removal for further processing.

What is claimed is:

1. A process for the production of photosensitive silver halide emulsions by (a) reaction of at least one silver salt with at least one halide in an aqueous dispersion medium, salt silver salt and said halide being soluble in said aqueous dispersion medium and/or (b) combination of silver halide emulsions in an aqueous dispersion medium containing a silver halide solvent said silver halide emulsions having different solubility in said aqueous dispersion medium containing said silver halide solvent, in a reaction chamber, at least partial removal of the aqueous dispersion medium and any compound dissolved therein in a cleaning stage and entry of the silver halide emulsion into a collection, vessel the improvement delivering the aqueous halide emulsion continously to the cleaning stage during reaction (a) and/or combination (b) and dividing the mass flow leaving the cleaning stage into two parts one part being delivered to the collecting vessel and one part being again delivered to the cleaning stage, the mass flow re-entering the cleaning stage being greater by a factor of at least 1.2 than the mass flow entering the collecting vessel.

2. A process as claimed in claim 1, wherein the aqueous silver halide emulsion is at least partly recycled from the collecting vessel to the reaction chamber and to the cleaning stage.

3. A process as claimed in claim 1, wherein the mass flow re-entering the cleaning stage partly enters the reaction chamber before re-entering the cleaning stage.

4. A process as claimed in claim 1, wherein an ultrafiltration module is used as the cleaning stage.

5. A process as claimed in claim 1, wherein the aqueous silver halide emulsion leaving the reaction chamber comprises 0.1 to 3 moles of silver halide, 0.01 to 12% of gelatine and 0.1 to 3 moles of salts dissolves in said emulsion per liter of said emulsion.

6. A process as claimed in claim 1, characterized in that the silver halide emulsion is at least partly recycled from the collecting vessel (3) to the circuit KS-1.

7. A process as claimed in claim 1, characterized in that, after passing through the cleaning stage (2), the emulsion is recycled partly ahead and partly behind the reaction chamber (1).

8. A process as claimed in claims 1, 2, 3, 4, 5, 6, or 7, characterized in that an ultrafiltration module is used as the cleaning stage (2).

* * * * *